United States Patent [19]

Yoshimi et al.

[11] 4,151,660

[45] May 1, 1979

[54] SOCKS FOR USE WITH FOOTGEAR

[75] Inventors: Hiroyuki Yoshimi; Yoshio Itoh, both of Tokyo, Japan

[73] Assignee: Maruki Trading Co., Ltd., Tokyo, Japan

[21] Appl. No.: 850,249

[22] Filed: Nov. 10, 1977

[30] Foreign Application Priority Data

Jun. 25, 1977 [JP] Japan ..... 52-83807[U]

[51] Int. Cl.[2] ..... A43B 3/10; A43B 7/06; A43B 13/38

[52] U.S. Cl. ..... 36/10; 36/3 B; 36/44

[58] Field of Search ..... 36/10, 44, 3 R, 3 B; 2/239, 241

[56] References Cited

U.S. PATENT DOCUMENTS

| | | | |
|---|---|---|---|
| 871,891 | 11/1907 | Roosa | 36/44 |
| 1,144,291 | 6/1915 | Boyer | 36/44 |
| 1,815,843 | 7/1931 | Higdem | 36/44 |
| 3,143,812 | 8/1964 | Bittner | 36/44 |
| 3,555,709 | 1/1971 | Raffaelli | 36/44 |
| 4,073,072 | 2/1978 | Gross et al. | 36/44 |

*Primary Examiner*—Patrick D. Lawson
*Attorney, Agent, or Firm*—Paul J. Sutton

[57] ABSTRACT

A sock for use with footgear is provided comprising a core formed of copper or copper-containing metal, a top ply of air-permeable material overlying the upper surface of said core, and a bottom ply of air-permeable material underlying the lower surface of the core, at least said top ply and bottom ply being joined together around the periphery of said core. The socks according to this invention maintain user's feet sanitary in his footgear for a period of time and keeps his feet from giving off offensive odors.

5 Claims, 8 Drawing Figures

SOCKS FOR USE WITH FOOTGEAR

BACKGROUND OF THE INVENTION

1. Field of the Invention

The present invention relates to socks for use with footgear, and more particularly to footgear socks which are capable of preserving germicidal properties for a long time due to a cooper or copper-containing metal material incorporated in their component parts.

2. Prior Art

It has been a common practice to place socks on the insoles of footgear such as shoes or the like for the purpose of providing improved ventilation to prevent human feet from getting musty as well as suppressing the emission of bad smell and also to provide a good feeling to the soles of the feet. However, it has been found that the prior art socks of the type described above are lacking in germicidal power, unable to significantly prevent the emission of foul odors, and have no efficacy against harmful germs such as honeycomb ringworms which are the cause of athlete's foot, saprogenous bacilli which are the cause of so called greasy feet, and the like.

Socks have heretofore been proposed having drugs, perfumes or the like incorporated in their component parts to provide germicidal effects. But none of them were able to preserve their effects for long. In addition, such type of socks had the disadvantage that they were expensive to manufacture.

It is known that copper metal is germicidal to chloera, corynebacteria, flamentous fungi, diphtheria, etc. and have also efficacy against honeycomb ringworms which are the cause of athlete's foot and saprogenous bacilli which are the cause of greasy feet. However, no footgear socks utilizing copper metal have been known.

OBJECTS AND SUMMARY OF THE INVENTION

An object of the invention is to provide a footgear sock capable of preserving germicidal properties for a long time.

Another object of the invention is to provide a footgear sock which is simple in construction and easy to manufacture.

Yet another object of the invention is to provide a footgear sock which is of robust construction, of lasting quality and has good shape-retaining property.

Other objects of the invention will become apparent from the following descriptions.

The footgear sock according to the present invention comprises a core formed of copper or a copper-containing metal, a top ply of air-permeable material covering the upper surface of said core, and a bottom ply of also air-permeable material covering the bottom surface of said core. At least said top and bottom plies are joined together around the marginal periphery of said sock to provide a complete sock assembly.

DESCRIPTION OF THE PREFERRED EMBODIMENTS

Figure 1:
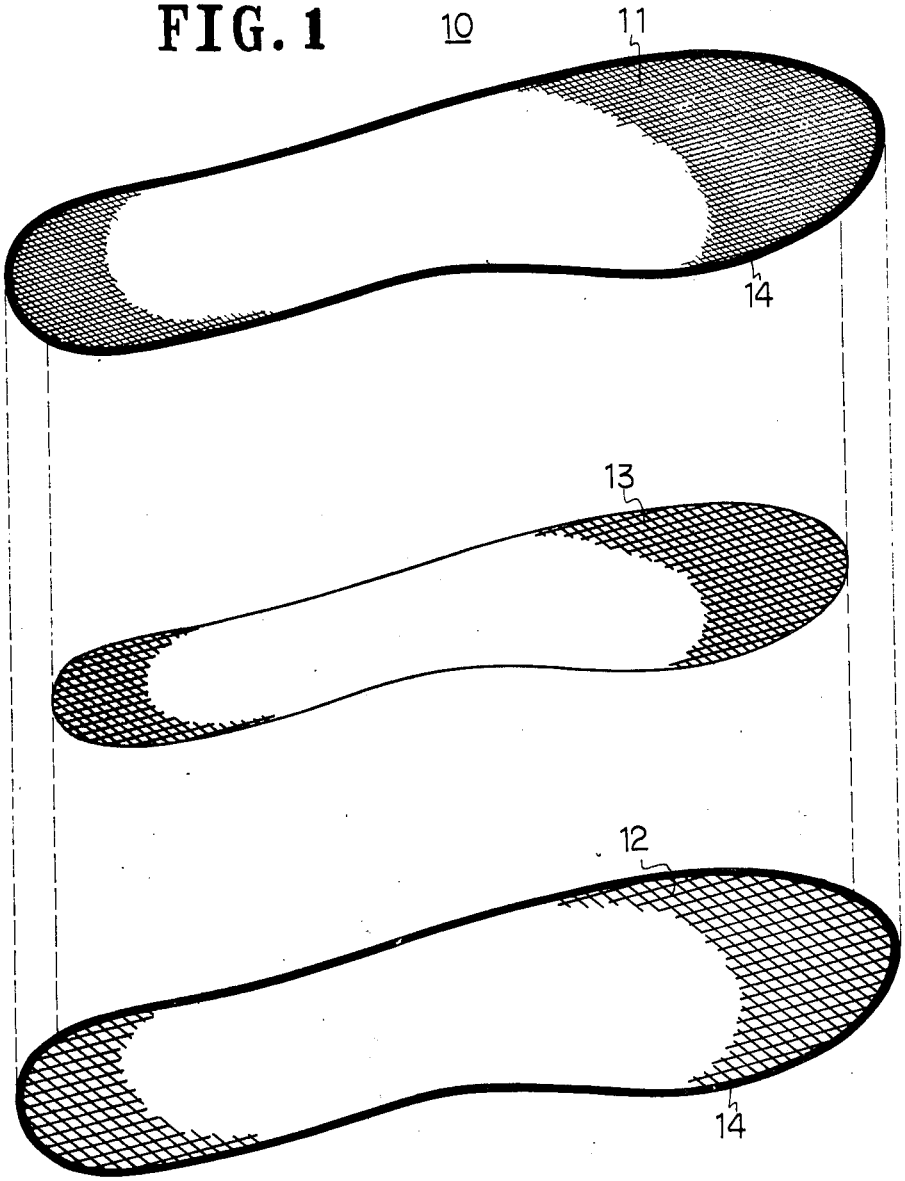
FIG. 1 is a perspective view of one form of the footgear sock according to the invention, illustrating the components of the sock in an exploded form.
Figure 2:
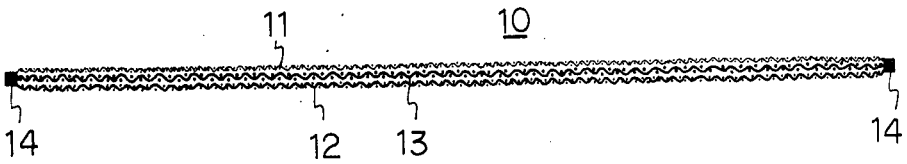
FIG. 2 is a vertical longitudinal sectional view of the sock shown in FIG. 1.

Referring to FIGS. 1 and 2, one form of the footgear sock according to the invention is generally denoted by 10. The footgear sock 10 comprises a top ply 11 knitted or woven of thermoplastic synthetic regin fibers such as polyvinyl chloride, polyethylene, polypropylene, polyvinylidene chloride or the like, a bottom ply 12 knitted or woven of the like material, and a core 13 interlaid between said top and bottom plies, said core being knitted or woven of fibers of copper, or copper-containing metal such as brass. The top ply 11 may preferably by knitted or woven with smaller stitches to provide comfortable feeling to the foot sole than the bottom ply 12 may be. The core 13 need not necessarily extend over the entire surface of the sock, but it may extend over the toe portion only where offensive odors are more likely to be produced.

In manufacturing the sock, a top ply 11 and a bottom ply 12 both formed of thermoplastic synthetic resin fibers are superposed on each other with a core 13 sandwiched therebetween. Then, the top and bottom plies may be heat sealed or welded together as by means of a welder or otherwise bonded together so as to form bonded peripheral margins 14 in conformity with the shape of a foot.

Figure 3:
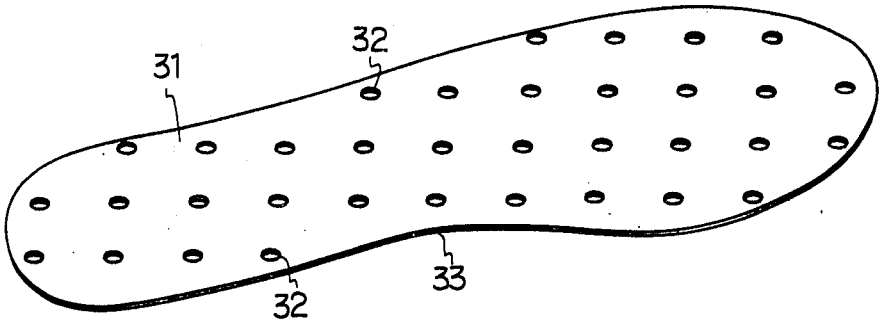
FIG. 3 is a perspective view of a core constituting one of components of another form of the sock according to the invention.

Instead of the core 13 knitted or woven of fibers of copper or copper-containing metal, a core 31 in the form of copper thin sheet such as foil as illustrated in FIG. 3 may be employed. Preferably the copper foil 31 may be formed with a plurality of small venting holes 32 to provide good ventilation. It is preferable that the copper foil 31 be backed with a reinforcing film 33 of thermoplastic synthetic resin in order to prevent the copper foil from being broken with a prolonged use. The film 33 may easily be bonded to the copper foil 32 in intimate contact as by heat sealing.

Figure 4:
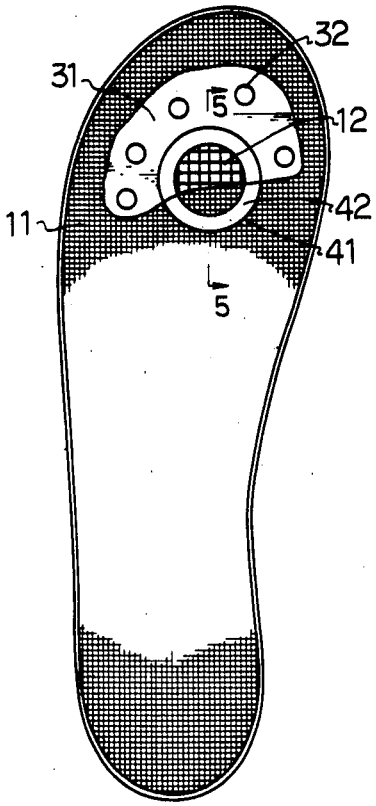
FIG. 4 is a top plan view of still another form of the sock of the invention, partly broken away, to illustrate a part of the interior of the sock.
Figure 5:
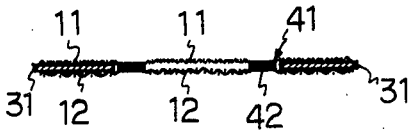
FIG. 5 is a sectional view taken along line 5—5 in FIG. 4.

FIG. 4 illustrates another embodiment of the invention wherein the components similar to those shown in FIGS. 1–3 are denoted by like reference numerals. In this embodiment the core 31 formed of copper foil is provided with at least one large aperture 41 in addition to small ventilation holes 32. Those portions of the top and bottom plies or layers 11, 12 covering the large aperture 41 are welded together or otherwise bonded together around the periphery of the aperture to form an annular welded portion 42 of a suitable radial width. FIG. 5 is an enlarged sectional view of the large aperture portion and its vicinity.

The welded portion 42 is shown as annular in FIGS. 4 and 5. However, it is to be understood that the top and bottom plies may be welded together over the entire aperture 41.

In welding the top and bottom layers or plies 11, 12 together as by means of a welder, the layers are welded together around but in spaced relation with the periphery of the core 13 or 31 interlaid between the layers to avoid sparking between the welder and the core, so that while in use the core 13 or 31 can be slidingly moved around between the top and bottom layers with the result that the edge of the core may cut off the welded peripheral margin of the layers. In the embodiment of FIG. 4 such breakage of the peripheral margin is avoided by the annular welded portion 42 acting to prevent the sliding displacement of the core 13 or 31. Furthermore, since in this embodiment the top and bottom plies 11, 12 are bonded together not only around their peripheral margins but also at the annular welded portion 42, those layers are less liable to be separated apart while in use and exhibit better shape-retaining ability.

Figure 6:
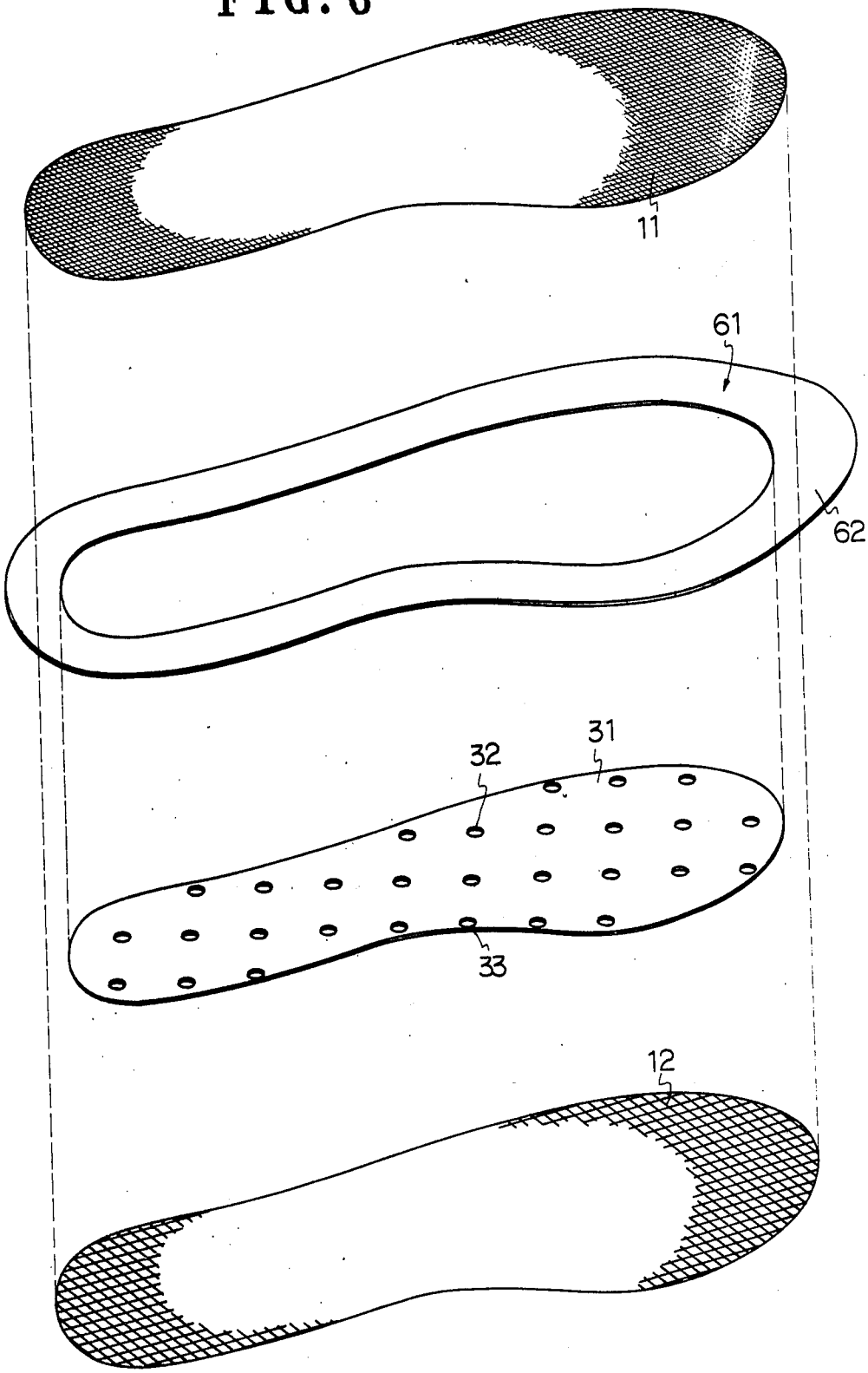
FIG. 6 is a perspective view of a further alternate form of the sock according to the invention, showing the various components in an exploded form.
Figure 7:
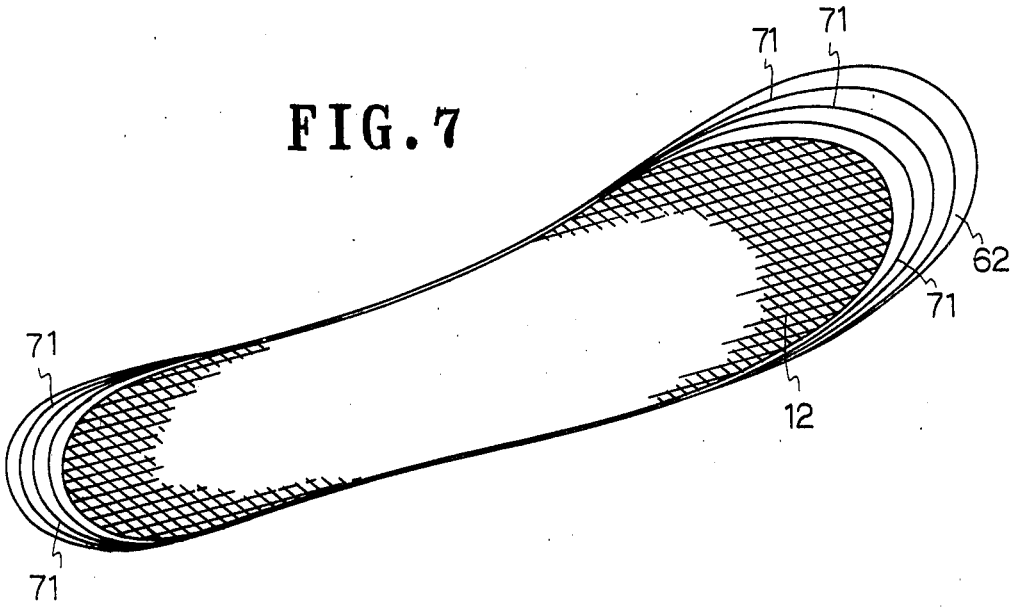
FIG. 7 is a perspective view of the sock shown in FIG. 6 as viewed from the bottom thereof.

FIGS. 6 and 7 illustrate a further alternate embodiment of the invention wherein the components similar to those in the preceding embodiments are designated by like reference numerals. As will be seen from FIG. 6, a sheet 61 of thermoplastic synthetic resin has a central opening which is adapted to fittingly receive a core 31. In fabricating a sock according to this embodiment, the sheet 61 having the core 31 fitted in its central opening is disposed between the top layer 11 and the bottom layer 12. The top and bottom layers 11, 12 may be of the same size as the sheet 61 so that these layers 11, 12 extend over the sheet 61. Then, the top layer 11, sheet 61 and bottom layer 12 are integrally welded together to define a marginal flat portion 62.

In the preceding embodiments wherein top and bottom plies 11, 12 alone are welded together, it is impossible to increase the area of weld portion since the fibrous materials alone are welded together. Consequently, in the embodiments described before, the peripheral margins of the sock can possibly become loose or be raveled. However, it is to be appreciated that the embodiment shown in FIGS. 6 and 7 is devoid of such disadvantage. Moreover, owing to the use of the sheet 61 having the core 31 fitted therein, the core 31 will never be dislocated in its sliding movement between the top and bottom layers even though said layers are welded to the sheet 61 in spaced relation with the periphery of the core 31 rather than closely adjacent to said periphery, and thus the sock in this embodiment is superior in its shape retention.

As shown in FIG. 7, the under surface of the peripheral flat portion 62 may be formed at the toe and/or heel portions thereof with score lines or guide lines 71 along which a user may sever off the sock at the toe and/or heel thereof to custom fit the length of the socks to his feet.

The sheet 61 may preferably be colored differently than the top and bottom layers 11, 12 to enhance the commercial value.

The top and bottom plies 11, 12 need not necessarily be made of thermoplastic synthetic resin but may be formed of natural fibre fabric, or other air-permeable materials such as sheets formed with a number of small holes.

Figure 8:
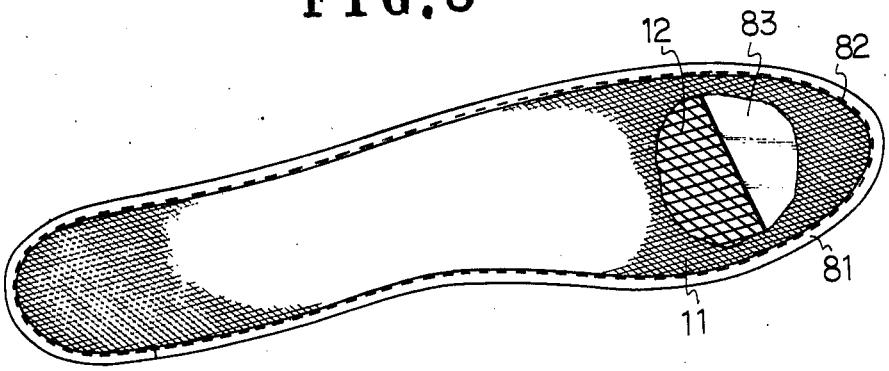
FIG. 8 is a perspective view of still another form of the sock according to the invention.

As shown in FIG. 8, an edging strip 81 may be wrapped around the periphery of the top and bottom plies 11, 12 and stitched to the plies with threads 82.

In place of the copper foil 31, one or several strips of copper sheet 83 may be placed at one or several locations between the top and bottom layers of the sock. The strip or strips of copper sheet 83 may extend to the outer periphery of the sock so that the edging 82, top and bottom plies and copper sheet strip may all be stitched together to provide reinforced stitched peripheral margins.

While the present invention has been described with reference to the preferred embodiments, it is to be understood that the invention is not limited to those embodiments but comprehend various changes and modifications which may be made without departing from the scope and spirit of the invention.

What is claimed is:

1. A sock for use with footgear comprising a core formed of copper or copper-containing metal, a top ply overlying the upper surface of said core, said ply being knitted or woven of thermoplastic resin, a bottom ply underlying the lower surface of said core, said bottom ply being knitted or woven of thermoplastic resin, and a sheet of thermoplastic resin having a predetermined width extending around the periphery of said sock between said top and bottom plies, said sheet and said top and bottom plies being integrally welded together to define a flat marginal portion of a predetermined width, said flat marginal portion being provided with guide lines along which a user can sever off the sock to fit the length of the sock to his foot.

2. A sock according to claim 1, wherein said core is knitted or woven of fibres of copper or copper-containing metal.

3. A sock according to claim 1, wherein said core is a thin sheet or foil of copper or copper-containing metal, said sheet being formed with a plurality of small venting holes therethrough.

4. A sock according to claim 3 wherein the under surface of said core is backed with a reinforcing film of thermoplastic resin.

5. A sock according to claim 1, wherein said core is provided with at least one large aperture, those portions of said top and bottom plies overlapping said large aperture being welded together either over the entire area of said aperture or around the periphery of the aperture.

* * * * *

UNITED STATES PATENT OFFICE

CERTIFICATE OF CORRECTION

Patent No. 4,151,660 Dated May 1, 1979

Inventor(s) HIROYUKI YOSHIMI and YOSHIO ITOH

It is certified that error appears in the above-identified patent and that said Letters Patent are hereby corrected as shown below:

Correct the spelling of Assignee to read:
--Maruko Trading Co., Ltd.--

Signed and Sealed this

*Fifteenth* Day of *January 1980*

[SEAL]

*Attest:*

SIDNEY A. DIAMOND

*Attesting Officer*

*Commissioner of Patents and Trademarks*